US011555349B2

(12) United States Patent
Lagarde

(10) Patent No.: US 11,555,349 B2
(45) Date of Patent: Jan. 17, 2023

(54) DEVICE FOR WINDING A SCREEN HAVING A HINGED WALL ATTACHMENT

(71) Applicant: SOMFY ACTIVITES SA, Cluses (FR)

(72) Inventor: Eric Lagarde, Sallanches (FR)

(73) Assignee: Somfy Activites SA, Cluses (FR)

( * ) Notice: Subject to any disclaimer, the term of this patent is extended or adjusted under 35 U.S.C. 154(b) by 545 days.

(21) Appl. No.: 15/745,985

(22) PCT Filed: Jul. 21, 2016

(86) PCT No.: PCT/EP2016/067462
§ 371 (c)(1),
(2) Date: Jan. 18, 2018

(87) PCT Pub. No.: WO2017/013229
PCT Pub. Date: Jan. 26, 2017

(65) Prior Publication Data

US 2018/0202225 A1 Jul. 19, 2018

Related U.S. Application Data

(63) Continuation-in-part of application No. PCT/EP2016/054805, filed on Mar. 7, 2016.

(30) Foreign Application Priority Data

Jul. 21, 2015 (FR) ..... 1556873

(51) Int. Cl.
*E06B 9/50* (2006.01)
*E06B 9/174* (2006.01)
(Continued)

(52) U.S. Cl.
CPC ..... *E06B 9/50* (2013.01); *E06B 9/174* (2013.01); *E06B 9/44* (2013.01); *E06B 9/72* (2013.01)

(58) Field of Classification Search
CPC .... E06B 2009/1743; E06B 9/50; E06B 9/174; E06B 9/44; E06B 9/72; A47H 1/13;
(Continued)

(56) References Cited

U.S. PATENT DOCUMENTS 1,314,358 A * 8/1919 Overman ..... A47H 1/13 248/257
1,468,167 A * 9/1923 Pecora ..... A47H 1/13 248/255

(Continued)

FOREIGN PATENT DOCUMENTS

CN 1518785 8/2004
CN 1742150 3/2006

(Continued)

OTHER PUBLICATIONS

Office Action dated Nov. 14, 2018 issued in the parent application No. CN 2016800421972.

(Continued)

*Primary Examiner* — Daniel P Cahn
*Assistant Examiner* — Jeremy C Ramsey
(74) *Attorney, Agent, or Firm* — Wissing Miller LLP

(57) ABSTRACT

The invention relates to a device for winding a screen (10) which comprises a tubular winder (12) defining a reference axis (100); a first wall attachment (18A) for fastening a first axial end portion (14A) of the tubular winder (12) to a first wall (16A) in a use position of the screen-winding device (10); and a second wall attachment (18B) for fastening a second axial end portion (14B) of the tubular winder (12) to a second wall (16B) in the use position of the screen-winding device (10). The first wall attachment (18A) comprises at least one tab (54) for fastening to the first wall (16A) and at least one first hinge (58) supported by the fastening tab (54) in order to guide a pivoting of the tubular
(Continued)

winder (12) about a first axis of articulation (200) that does not intersect with the reference axis (100) and, in the use position, orthogonal to the reference axis (100). The first wall attachment (18A) comprises a second jointed hinge (66) supported by the fastening tab (54) in order to guide the first hinge (58) so as to rotate about a second axis of articulation (300) that does not intersect with the reference axis and is not parallel to the first axis of articulation (200).

13 Claims, 8 Drawing Sheets

(51) Int. Cl.
*E06B 9/44* (2006.01)
*E06B 9/72* (2006.01)

(58) Field of Classification Search
CPC ..... E05D 5/13; E05D 2005/102; E05D 3/13; H04M 1/022; Y10T 403/32008
See application file for complete search history.

(56) References Cited

U.S. PATENT DOCUMENTS 1,782,131 A * 11/1930 Broberg ..... E06B 9/50 248/267
2,001,864 A * 5/1935 Benjinsohn ..... E06B 9/50 248/267
2,141,095 A * 12/1938 Tennant ..... A47H 1/13 248/253
2,198,089 A * 4/1940 Peckham ..... A47H 5/09 248/265
2,201,787 A * 5/1940 Peckham ..... A47H 5/09 248/265
2,277,324 A * 3/1942 Holwick ..... E06B 9/50 248/254
2,301,863 A * 11/1942 Forse ..... E06B 9/50 160/41
2,802,523 A * 8/1957 Anderle ..... E06B 9/323 160/167 R
3,389,738 A * 6/1968 Roth ..... A47H 23/10 160/120
3,946,978 A * 3/1976 Evans ..... A47H 1/102 248/264
6,371,192 B1 4/2002 Anderson et al.
6,499,709 B1 * 12/2002 Parent ..... E06B 9/42 16/319
6,688,479 B2 * 2/2004 Nei ..... A47H 1/022 248/265
2004/0129850 A1 * 7/2004 Kirby ..... E06B 9/42 248/266
2004/0169490 A1 9/2004 Heurtault
2006/0278786 A1 * 12/2006 Kirby ..... E06B 9/50 248/267
2007/0199662 A1 * 8/2007 Miller ..... E06B 9/174 160/23.1
2008/0236763 A1 10/2008 Kates
2008/0289775 A1 * 11/2008 Lukos ..... E04F 10/0662 160/242
2013/0153162 A1 * 6/2013 Blair ..... B23P 6/00 160/310
2015/0315843 A1 * 11/2015 Lin ..... E06B 9/78 160/323.1
2017/0074037 A1 * 3/2017 Campagna ..... F16H 1/006
2017/0247943 A1 * 8/2017 Ng ..... E06B 9/42
2018/0023340 A1 * 1/2018 Goldberg ..... E06B 9/56 160/324
2018/0128047 A1 * 5/2018 Ng ..... E06B 9/50
2018/0313082 A1 * 11/2018 Klein ..... E06B 9/17007
2019/0085626 A1 * 3/2019 Ng ..... E06B 9/50
2019/0284875 A1 * 9/2019 Ng ..... E06B 9/50
2019/0316414 A1 * 10/2019 Zhang ..... E06B 9/50
2020/0115958 A1 * 4/2020 Miroshnichenko ..... E06B 9/42

FOREIGN PATENT DOCUMENTS

| | | |
|---|---|---|
| CN | 101160444 | 4/2008 |
| CN | 201517341 | 6/2010 |
| DE | 20005831 U1 | 7/2000 |
| EP | 2631411 | 8/2013 |
| FR | 2842860 | 1/2004 |
| WO | 2004074620 | 9/2004 |

OTHER PUBLICATIONS

International Search Report and Written Opinion mailed in PCT/IB2016/067462 dated Oct. 20, 2016.

* cited by examiner

18A

Fig.9
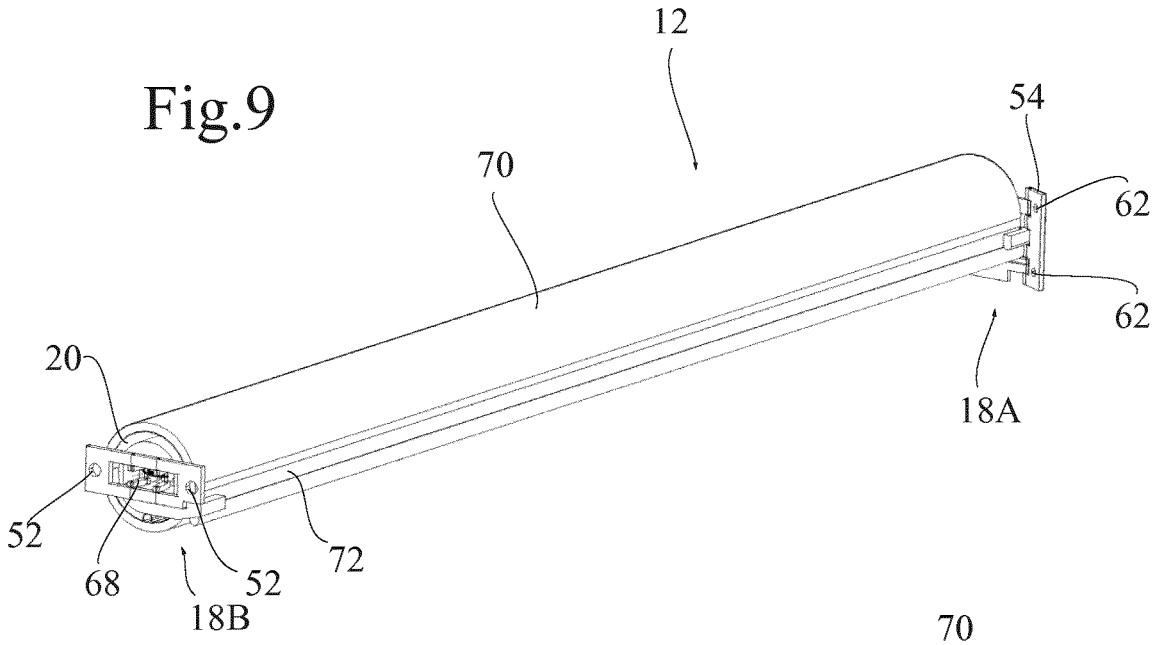
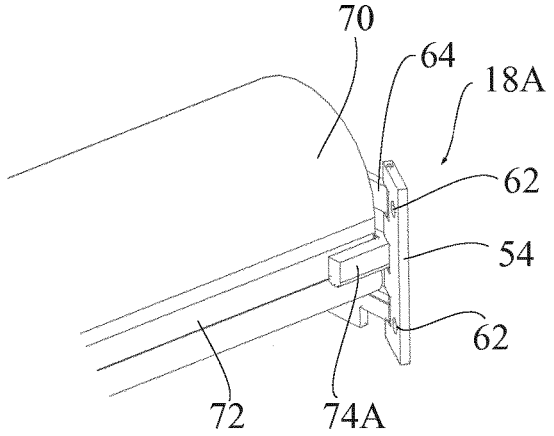
Fig.10
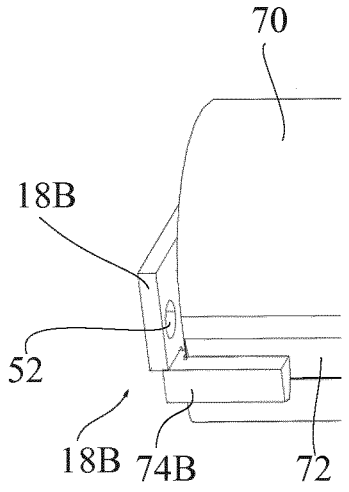
Fig.11

DEVICE FOR WINDING A SCREEN HAVING A HINGED WALL ATTACHMENT

This application is a 371 of PCT/EP2016/067462 filed on Jul. 21, 2016, published on Jan. 26, 2017 under publication number WO 2017/013229, which claims priority benefits from French Patent Application No. 1556873 filed on Jul. 21, 2015, the disclosure of which is incorporated herein by reference, and which claims priority benefits as a continuation-in-part from International Patent Application No. PCT/EP2016/054805 filed on Mar. 7, 2016, the disclosure of which is incorporated herein by reference.

TECHNICAL FIELD OF THE INVENTION

The invention relates to a device for winding a screen, and in particular a screen for closing off an opening in a building or a projection screen, and in particular, but not exclusively, a motorized winding device, and more specifically, but not exclusively, a motorized device having an onboard electrical energy reserve.

BACKGROUND OF THE INVENTION

In order to facilitate the replacement of battery cells for a screen winder, it has been proposed in document U.S. Pat. No. 6,371,192 to provide, in the winder, a housing closed by an access hatch situated on a planar upper wall of the box of the winder. However, access to this wall is not always easy when the winding device is fastened at a small distance from the lintel in the upper part of an opening in a building. It is then necessary to completely disassemble the winder to access the access hatch.

To resolve this problem, it has been proposed in document US 2013/0153162 to fasten the box of the winder to the walls of the opening by attachments allowing the box to pivot around a pivot axis parallel to the rotation axis of the winder. Thus, it is possible to pivot the box around this pivot axis in order to access the access hatch of the battery cell housing without difficulty, which is located on a front face or an upper face of the box. However, these solutions are not transposable to a winder whose ceils are positioned inside the winding tube.

BRIEF DESCRIPTION OF THE INVENTION

The invention seeks to resolve the drawbacks of the state of the art and propose means for facilitating access to one end of a screen winder, in particular for maintenance operations.

To that end, according to a first aspect of the invention, proposed is a device for winding a screen including:

- a tubular winder defining a reference axis;
- a first wall attachment tor fastening a first axial end portion of the tubular winder to a first wall, and
- a second wall attachment for fastening a second axial end portion of the tubular winder to a second wall, in the use position of the screen winding device and defined by claim 1.

Various embodiments of the screen winding device are defined by the dependent claims.

When the first wall attachment is fastened to a wall, the first hinge allows an operator to manipulate the tubular winder by its second end portion, while the first end portion remains supported and guided by the wall attachment in its pivoting movement around the first axis of articulation of the hinge. It is then easy for a single person to intervene on the winding device, for example for a maintenance operation requiring access to the second end portion of the tubular winder.

The expression "wall" is intended, in the context of the present invention, to include any type of wall in a building, and in particular any interior or exterior opening frame of the building, whether it involves a doorframe or an architrave, at the lintel or studs, or whether it involves a wall of a partition, a celling or drop celling, for the suspension of a sun protection or projection screen. The term "wall attachment" is intended to include any type of attachment allowing fastening to a wall within the general meaning given above. A hinge refers to any type of articulation with a degree of rotational freedom.

According to one embodiment, the tubular winder includes a winding tube, the screen winding device further including a first guide bearing to guide the rotation of the winding tube around the reference axis relative to the first wall attachment. Preferably, the winding device further includes a second guide bearing inserted between the winding tube and the second wall attachment. Each guide bearing can be integrated into the associated wall attachment, or positioned between the associated end portion of the tubular winder and the winding tube.

The invention is particularly suitable for an embodiment in which the tubular winder includes a motorized actuator for rotating the winding tube around the reference axis, the actuator preferably being at least partially housed inside the winding tube.

It is possible to provide that the second portion of the tubular winder is formed by an end of the actuator. The actuator, in particular an end part of the actuator such as the front face of the head, then becomes directly accessible at the end of the winder when the winder, maintained at the first wall by the first articulated attachment, has pivoted around the axis of articulation.

According to one embodiment, the tubular winder includes a guide bearing inserted between the winding tube and the actuator.

The invention is particularly suitable for an embodiment in which the tubular winder includes a housing for batteries or battery cells, the housing preferably being situated inside the winding tube, on the side of the second portion. Various alternatives can be considered. The removal of the batteries or battery cells may advantageously be done through the second portion of the winder, directly accessible once the winder has been pivoted around the first axis of articulation.

According to one embodiment, the housing for the batteries or battery cells is situated inside a case of the actuator. Preferably, the head of the actuator comprises a passage hatch for the batteries or battery cells.

According to one embodiment, the tubular winder has, at its second end, an end piece having a passage, preferably able to be closed by a hatch, and through which the batteries or battery cells can pass.

According to one embodiment, the screen winding device according to the invention further comprises a screen wound on the winding tube, the screen being provided with a load bar.

To prevent the pivoting of the winder around the first axis of articulation from damaging the screen, it is naturally of interest for the screen to be completely wound and the load bar to be in an extreme winding position before intervening on the device in order to pivot the winder, and for this position to be retained throughout the entire procedure. To that end, the extreme winding position is preferably defined by at least one stop secured to one of the first and second axial end portions of the tubular winder or the first wall attachment, and interfering with the load bar in the end of winding travel position. Preferably, two stops are positioned at the two axial ends of the tubular winder: a first stop positioned on the first wall attachment or the first axial end portion of the winder, and a second stop positioned on the second axial end portion of the winder. The stop(s) must be stationary relative to the reference axis, which requires, in the case of a stop positioned on the first wall attachment, that this stop be secured to a part of the wall attachment that is not movable relative to the first axial end portion when the tubular winder pivots around the first hinge. If applicable, the stop(s) can be positioned so as to press the load bar against the screen wound in the extreme winding position.

The extreme winding position in question here is a position which, if applicable, does not need to be reached in the usage sequences of the winding device, but rather during specific phases such as assembly, disassembly or maintenance operations. This means that it is in particular possible to provide that the screen winding device also includes means for defining an end of winding travel position, situated between the two extreme winding and unwinding positions, and if applicable an end of unwinding travel position situated between the end of winding travel position and the extreme unwinding position. In practice, it is possible, if applicable, to provide slight tensioning of the screen in the extreme winding position.

In the case of a nonmotorized device, the end of use travel position(s) can for example be defined by retractable stops and the extreme winding and unwinding position(s) by stationary stops. Alternatively, it is possible to provide a stop movable between one or several end of winding travel positions and the extreme winding position, and if applicable the same for unwinding.

In the case of a motorized winding device, the end of use travel position(s) can for example be defined by end of travel sensors or by position sensors connected to an actuator command. It is also possible to consider that the actuator command determines the end of use travel positions by counting time. One has the advantage of providing ergonomics of the man-machine control interface of the actuator command, which makes it possible to clearly distinguish the winding and unwinding commands in the normal operating range between the end of use travels, and the winding command to the extreme winding position, it is for example possible to provide that the man-machine interface requires the prior passage to a maintenance mode to next allow complete winding of the screen to the extreme winding position. It is also possible to provide a particular sequence with the man-machine interface corresponding to this command. The passage to maintenance mode may also be automatic, in particular in response to low residual energy level information of the batteries of the winding device.

Preferably, the second wall attachment is able to guide the second axial end portion of the tubular winder when the tubular winder pivots around the first axis of articulation, between an intermediate assembly position and the use position. To that end, the second wall attachment may in particular comprise a guideway, for example made by a groove, making it possible, while the first wall attachment is already fastened to the first wall and the first end portion of the tubular winder is already assembled on the first wall attachment, to engage the second portion of the winder in the intermediate mounting position, then to guide the second end portion of the winder to its final assembled position.

To allow greater travel of the winder, it is possible to provide that the winding device includes a retractable support link, providing the connection between the second wall attachment and the second end portion of the tubular winder, to support the second end portion of the winder in a suspended position. The retractable support link can advantageously be secured to the second wall attachment. This link allows an installer to suspend the second end of the tubular winder, before mounting the winding device in its use position or during disassembly of the winding device from its use position. This allows them to perform these assembly and disassembly manipulations, as well as to change the batteries or battery cells with one hand, without needing to support the second end, if the elements of the winding device are axially fastened to one another.

The fact that the first wall attachment includes a second hinge making it possible to guide the rotation of the orientation tab around at least one second axis of articulation not parallel to the first axis of articulation makes it possible to thus provide two degrees of rotational freedom to the first end portion of the tubular winder, which allows an installer to position the first end of the blind at the first wall attachment very easily, without being bothered by the elements of the surrounding frame, such as the wall or window, a window handle, from a position on the ground. Preferably, the first hinge has a large travel angle, preferably greater than 90°, and preferably greater than 120°. Likewise, the second hinge has a large travel angle, preferably greater than 90°, and preferably greater than 120°. Preferably, the second axis of articulation is orthogonal to the first axis of articulation.

According to one embodiment, the tubular winder includes a compensating spring.

According to one embodiment, the compensating spring is kinematically connected by one end to the first wall attachment or to the second wall attachment and by a second end to the winding tube. Preferably, the compensating spring is kinematically connected by a first end to the case of the actuator and by a second end to an output shaft of the actuator.

BRIEF DESCRIPTION OF THE FIGURES

Other features and advantages of the Invention will emerge from reading the following description, in reference to the appended figures, which illustrate:

FIG. 9, an isometric view of a device for winding a screen according to a sixth embodiment;

FIG. 10, a detail of the winding device of FIG. 9;

FIG. 11, another detail of the winding device of FIG. 9;

For greater clarity, identical or similar elements are identified using identical reference signs in all of the figures.

DETAILED DESCRIPTION OF THE INVENTION

Figure 1:
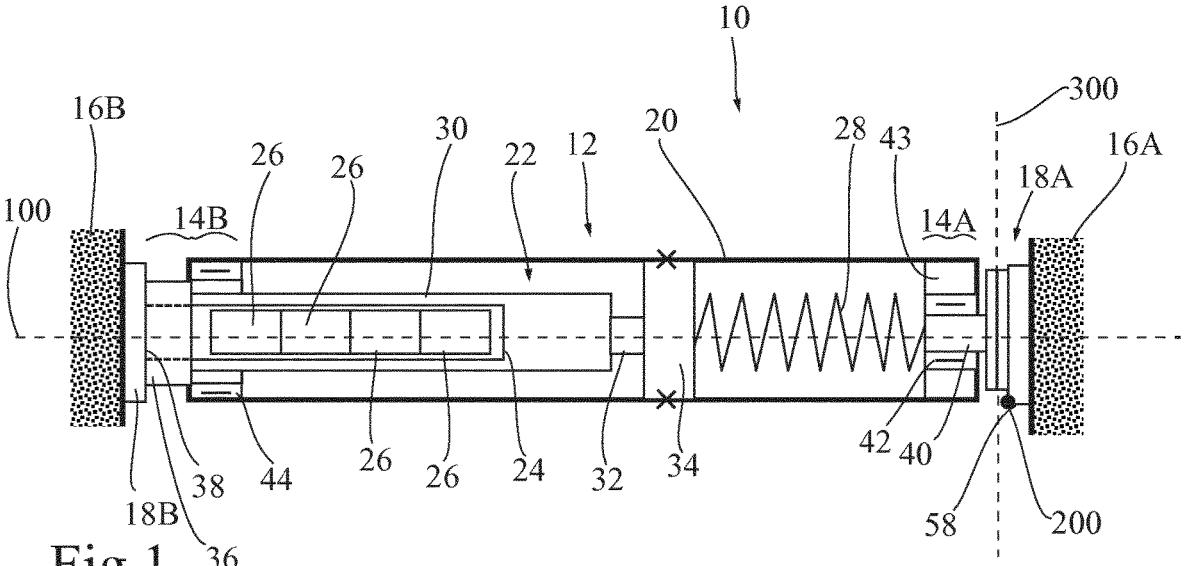
FIG. 1, a schematic view in a horizontal plane of a device for winding a screen according to a first embodiment of the invention, in a use position.

FIG. 1 illustrates a device 10 for winding a screen (not shown), mounted in a frame of the door or window opening of a building. The winding device 10 includes a tubular winder 12 having two opposite axial end portions 14A, 14B, a first of the axial end portions 14A being fastened to a first wall 16A of the frame by a first wall attachment 18A illustrated in detail in FIGS. 4, 12, 13, 14, 15 and the second axial end portion 14B being fastened to a second wall 16B by a second wall attachment 18B illustrated in detail in FIG. 5.

The tubular winder 12 defines a reference axis 100 and includes a winding tube 20, a motorized actuator 22 to rotate the winding tube 20 around the reference axis 100, a housing 24 for batteries or battery cells 26 powering the actuator 22, and a compensating spring 28, working by torsion around the reference axis 100 to return the winding tube 20 toward a wound position.

The actuator 22 and the housing 24 for the batteries or battery cells 26 are positioned at least partially inside the winding tube 20, closer to the second end portion 14B than the first end portion 14A. The first end portion 14A is opposite the end of the tubular winder receiving the actuator 22. The actuator 22 may for example and in a known manner comprise a generally cylindrical case 30 inserted into the winding tube 20. Housed in the case 30 are an electronic control unit (not shown), an electric motor of any type and a reducing gear (not shown), the motor having a stator that is stationary relative to the case 30, and a rotor driving, via the reducing gear, an output shaft 32. The output shaft 32 drives the winding lube 20 via a driving wheel 34 fastened in rotation on the output shaft 32 and on the winding tube 20. The housing 24 for the batteries or battery cells 26 may, if applicable, be integrated info the case 30 of the actuator 22. The electronic control unit sees to the operation of the motor by creating a connection, based on the received movement orders, between the power supply of the batteries or battery cells and the motor. In this embodiment, the actuator 22 includes a head 36, closing one end of the case 30, and which protrudes outside the winding tube 20 while making up part of the second portion 14B of the tubular winder 12. The head 36 of the actuator allows the support of the actuator 22 and consequently the winding tube 20 at the second end portion 14B. It additionally makes it possible to react torque at the output of the actuator and is therefore blocked in rotation relative to the second wall attachment 18B. It may be provided with a hatch 38 for accessing the housing 24. In particular, the hatch 38 assumes the form of a lid connected by a bayonet device to the head 38. Reliefs are provided on the outside of the hatch to make it possible to rotate the latter relative to the head 36 by hand or using a tool.

The first end portion 14A includes a shaft 40 fastened to the first wall attachment 16A and a first guide bearing 42, positioned between a wheel 43 secured to the winding tube 20 and the shaft 40. Advantageously, it is possible to provide axial fastening means (not shown) between the wheel 43 and the shaft 40 to ensure translational blocking between the wheel 43 and the shaft 40 and to keep the second end of the winding device fastened to the first wall attachment. The compensating spring 23, here shown schematically, can be made in a known manner by one or several resilient elements, such as torsion springs, positioned in series or in parallel, to obtain the desired elongation and stiffness characteristics. The spring 28 works between the shaft 40 and the drive wheel 34 of the winding tube 20, which is in turn secured to the winding tube 20.

A second bearing 44 is positioned between the case 30 of the actuator 22 and the winding tube 20, preferably at the second end portion 14B. According to one example embodiment, the head 36 of the actuator 22 is provided with an end piece made up of a slug 46, for example a square slug, intended to engage in a groove 48 provided to that end in the second wall attachment and illustrated in FIG. 5, the groove being configured to allow the square slug 46 to follow an engagement trajectory before falling by gravity info a retaining housing 50 in which the groove 48 emerges. Alternatively, the head is provided with two slugs 46 able to slide in the groove 48 and thus to maintain the actuator in rotation relative to the second wall attachment. Instead of the retaining housing 50, it is possible to provide, on either side of the groove, beads mounted on a spring allowing the passage of the end piece and ensuring maintenance thereof in the groove 48. The second attachment is also provided with fastening holes 52 to engage fastening screws for fastening to the wall 16B. According to another example embodiment, the head of the actuator is a star-shaped or hexagonal head, able to slide in a housing provided to that end on the second wall attachment, this housing being able to be closed by a retractable hatch, which, when it is closed, keeps the head in place in the housing. Alternatively, it is the head that comprises a housing for a square slug protruding from the second wall attachment, the head being able to be closed by various means, such as a pin or a screw. Other examples may also be considered, such as placing a clip blocking the head relative to the second wall attachment. It is also possible to consider a wall attachment made from two parts resiliency connected to one another, this making it possible to insert the head in an axial direction and block it by clips positioned on one and/or the other of the parts.

According to one example embodiment, the first wall attachment 18A comprises at least one fastening tab 54 for fastening to the first wall 16A and an orientation tab 56 supported by the fastening tab 54 via at least a first hinge 58 to guide the first axial end portion 14A of the tubular winder 12 in a pivoting movement around a first axis of articulation 200 separated from the reference axis 100, the first axis of articulation 100 being stationary relative to the fastening tab 54. The shaft 40 of the first end portion 14A of the tubular winder 12 has a hexagonal section (or more generally a noncircular section) allowing it to be inserted forcibly into a hole with a corresponding section 60 formed on the orientation tab 56, so as to secure the first end portion 14A and the orientation tab 56 to one another in both rotation and translation. If applicable, positive fastening in translation can be considered, for example by adding a fastening screw. The fastening tab 54 further has fastening holes 62 to engage fastening screws (not shown) for fastening to the wall 16A. Alternatively, the shaft 40 is made integral with the orientation tab. According to another embodiment, the orientation tab 56 is U-shaped, able to be closed by an axis and in which the end of the shaft 40 of the first end portion 14A of the tubular winder 12, comprising flats, is inserted. Particularly advantageously, the shaft 40 of the first end portion 14A cooperates with the U shape of the orientation tab at a portion with a smaller diameter, the larger diameter at the end of the shaft 40 passing behind the U shape, thus ensuring the axial maintenance of the first end portion 14A at the first wall attachment 18A.

Figure 2:
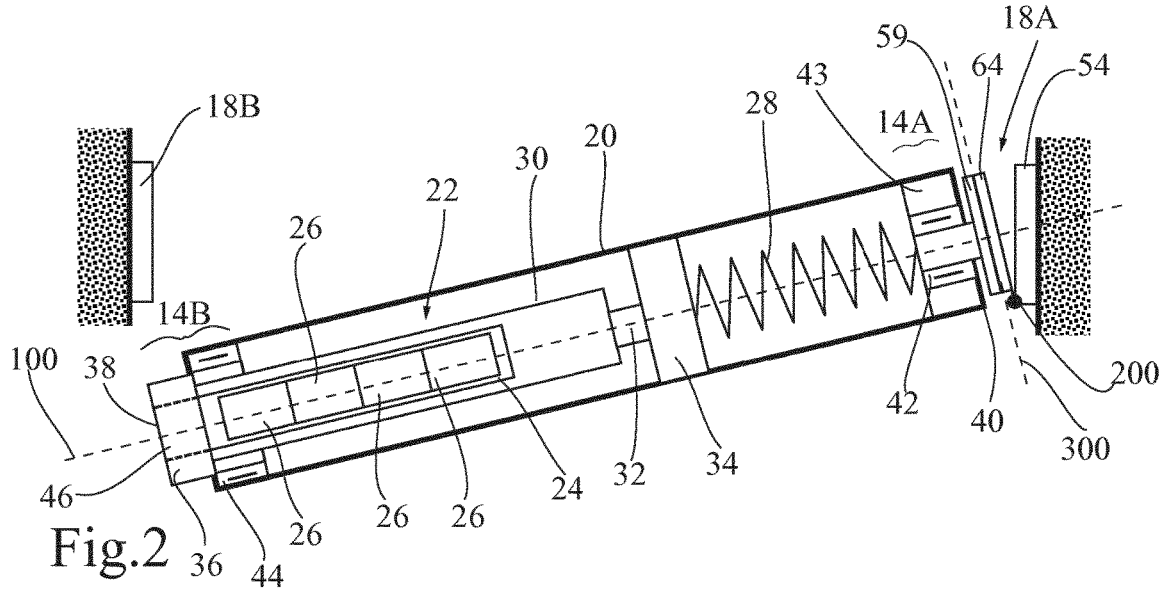
FIG. 2, a schematic overview of the winding device for a screen according to the first embodiment of the invention, in a maintenance position.
Figure 3:
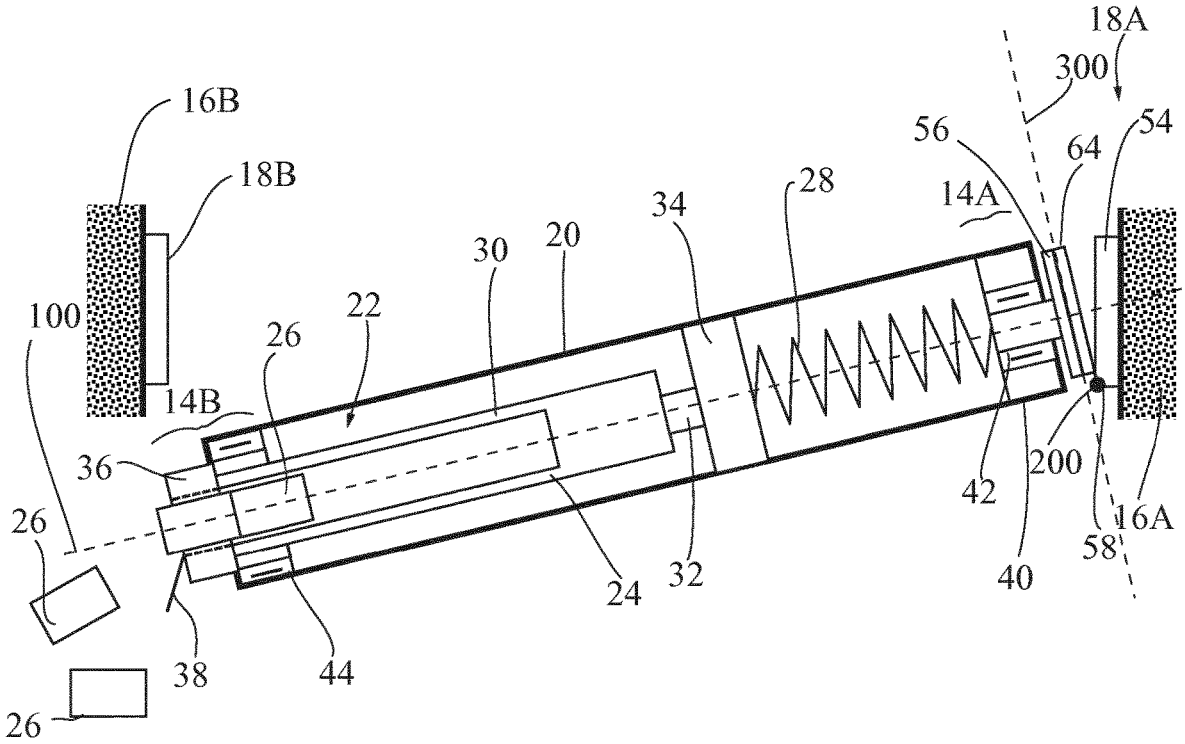
FIG. 3, a schematic overview of the device for winding a screen according to the first embodiment of the invention, in the maintenance position, after removal of the batteries.

In the use position of FIG. 1, the first axis of articulation 200 is preferably orthogonal to the reference axis 100, and oriented so as to allow the square slug 46 to follow the trajectory defined by the groove 48. Inasmuch as the groove 48 is meant to be oriented horizontally, the first axis of articulation 200 is therefore preferably vertical in the use position. It is thus possible, as illustrated in FIG. 2, to free the tubular winder 12 from the second attachment 18B, to bring it, after pivoting around the first axis of articulation 200, into a maintenance position providing free access to the second end portion 14B of the tubular winder 12. It is then possible to operate on this second end portion 14B, and in particular on the head 36 of the actuator 22, for adjusting operations or other maintenance operations. It is in particular possible, as illustrated in FIG. 3, to access the housing 24 to change the batteries or battery cells 26. Advantageously, the batteries or battery cells 26 are kept connected to one another by a plastic film or in a tube provided to that end and in turn closed by a stopper fastened removably to the tube by a bayonet or screw device. Reliefs are provided on the outside of the stopper to make it possible to rotate the latter relative to the tube by hand or using a tool.

Figure 4:
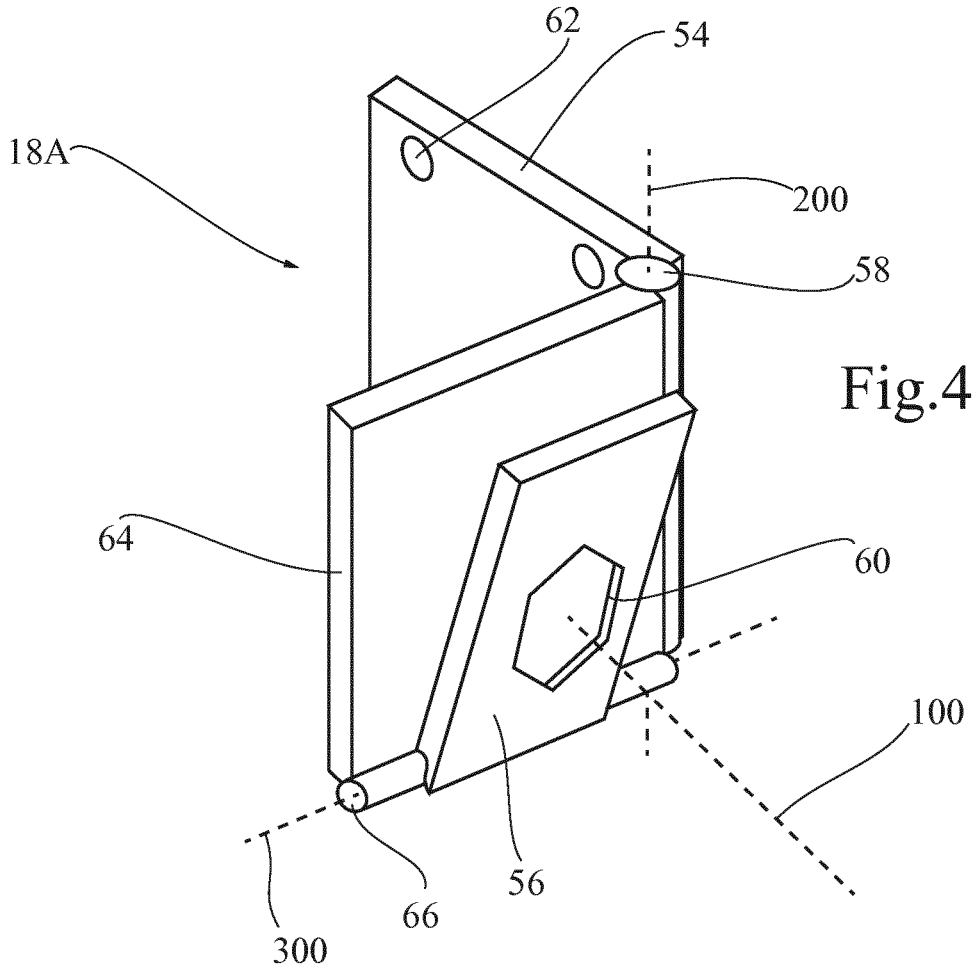
FIG. 4, a schematic view of one embodiment of a first wall attachment for the device of FIG. 1.
Figure 5:
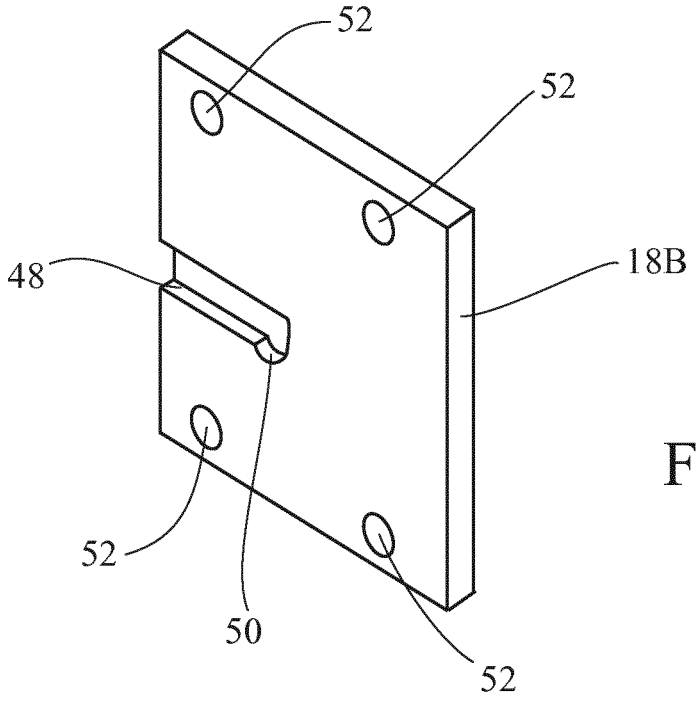
FIG. 5, a schematic overview of a device for winding a screen according to a second embodiment of the invention.

The first wall attachment 18A of the winding device 10 of FIGS. 1 to 3 may have only one axis of articulation 200, but preferably has two axes of articulation 200, 300, as illustrated in FIG. 4. To that end, the first wall attachment 18A has an intermediate tab 64 inserted between the orientation tab 56 and the fastening tab 54. A second hinge 66 allows the orientation tab 56 to pivot around a second axis of articulation 300 orthogonal to the reference axis 100, not secant with the reference axis 100, and not parallel to the first axis of articulation 200. The first axis of articulation 200 and the second axis of articulation 300, in the use position of the winding device, are preferably orthogonal, and coplanar or substantially coplanar, in that they are situated in two planes perpendicular to the reference axis 100 and less than 1 cm away from one another, substantially corresponding to the thickness of the parts making up the first wall attachment. This double articulation makes it possible to maneuver the second portion 14B of the tubular winder 12 with ease while keeping the first end portion 14A supported by the first wall attachment 18A.

The structure of the first wall attachment may assume different forms. It is in particular possible for one of the articulation tabs to comprise a cutout making it possible to receive another tab when the latter is bent. In this case, the two tabs are coplanar and therefore the two axes of articulation may also be coplanar.

Figure 6:
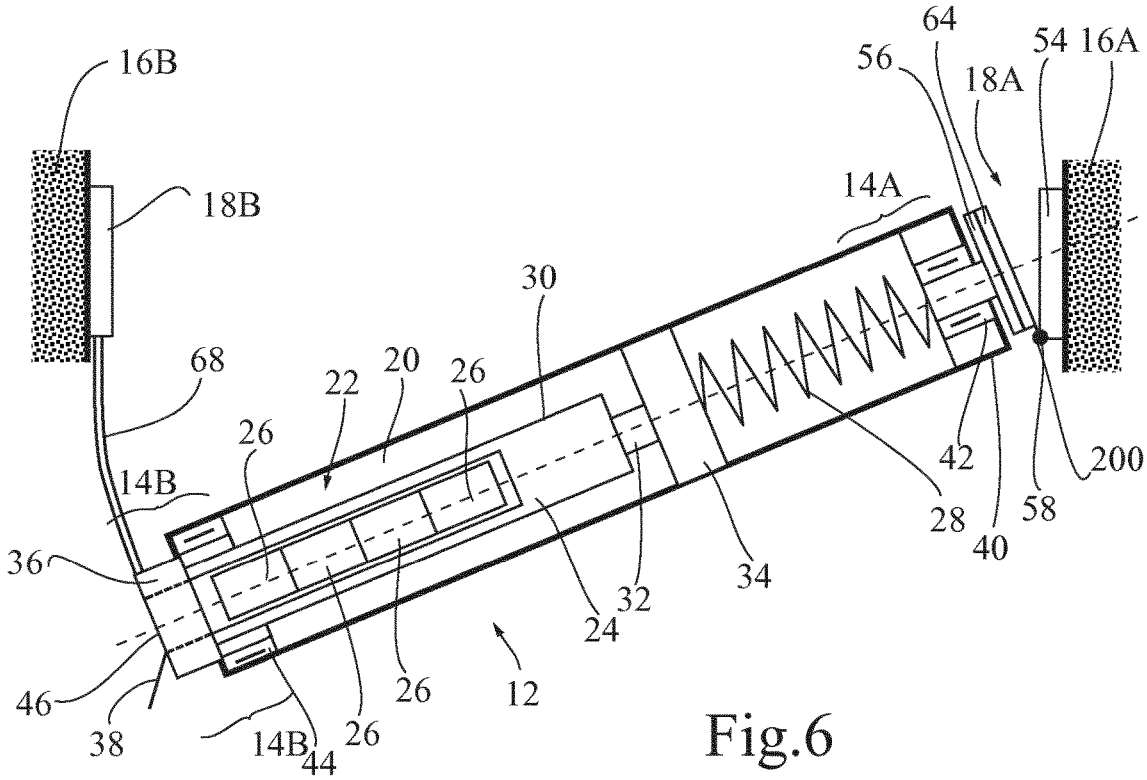
FIG. 6, a schematic overview of a device for winding a screen according to a third embodiment of the invention.

FIG. 6 shows a screen winding device 10 according to a second embodiment, which differs from the preceding embodiment by the addition of a retractable support link 68 providing the connection between the second wall attachment 18B and the second end portion 14B of the tubular winder 12, to support the second portion 14B of the winder in a suspended position illustrated in FIG. 6. The retractable support link 68 can be flexible or rigid, telescoping or articulated, and may be secured to the second wall attachment 18B or the second end portion 14B.

The support link 68 may in particular be made up of a guide rail or may be a simple detachable link retaining the second end portion 14B in the suspended position to replace the battery cells. The installer thus no longer needs to maintain this end portion and may very easily change the battery cells (opening the battery ceil hatch, receiving battery ceils to be changed, performing the replacement and closing the hatch).

Figure 7:
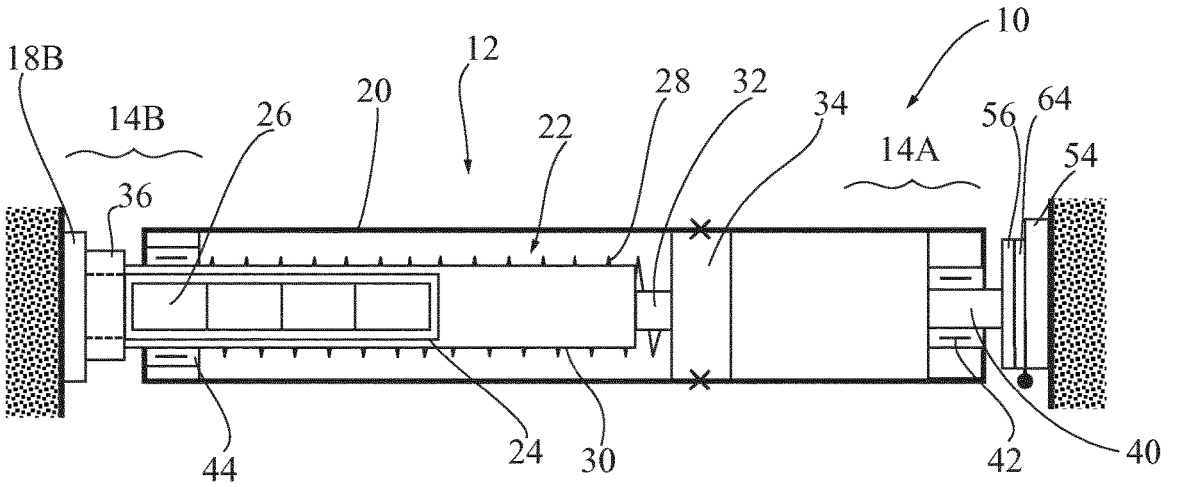
FIG. 7, a schematic overview of a device for winding a screen according to a fourth embodiment of the invention.

FIG. 7 illustrates a third embodiment of the invention, which differs from the previous embodiments by the positioning of the compensating spring 28, one of the ends of which is fastened to the case 30 of the actuator 22 and the other end of which is fastened to the output shaft 32 of the actuator 22, for example in the manner described in document WO 03/083245.

Figure 8:
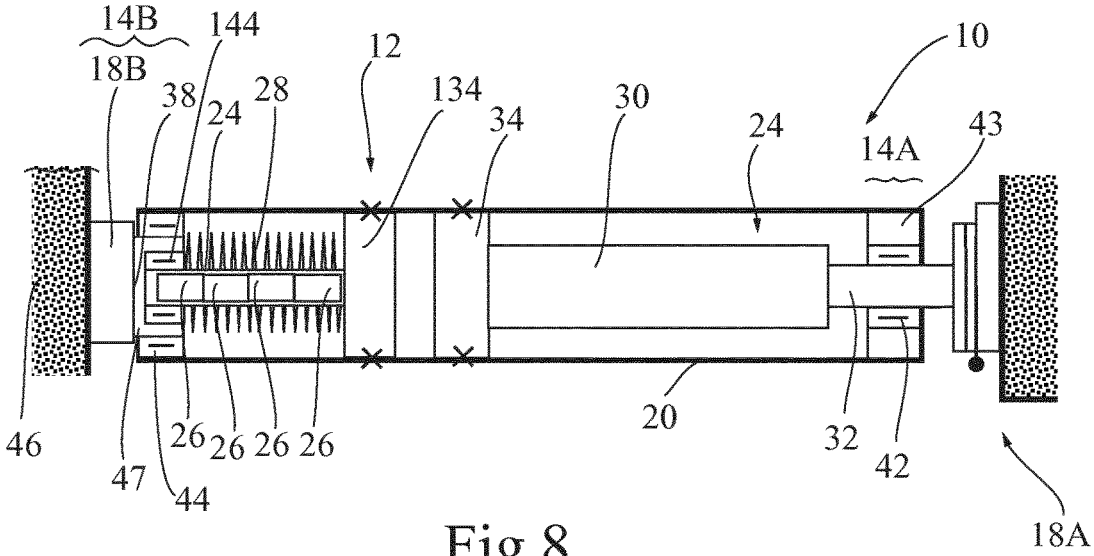
FIG. 8, a schematic overview of a device for winding a screen according to a fifth embodiment of the invention.
Figure 12:
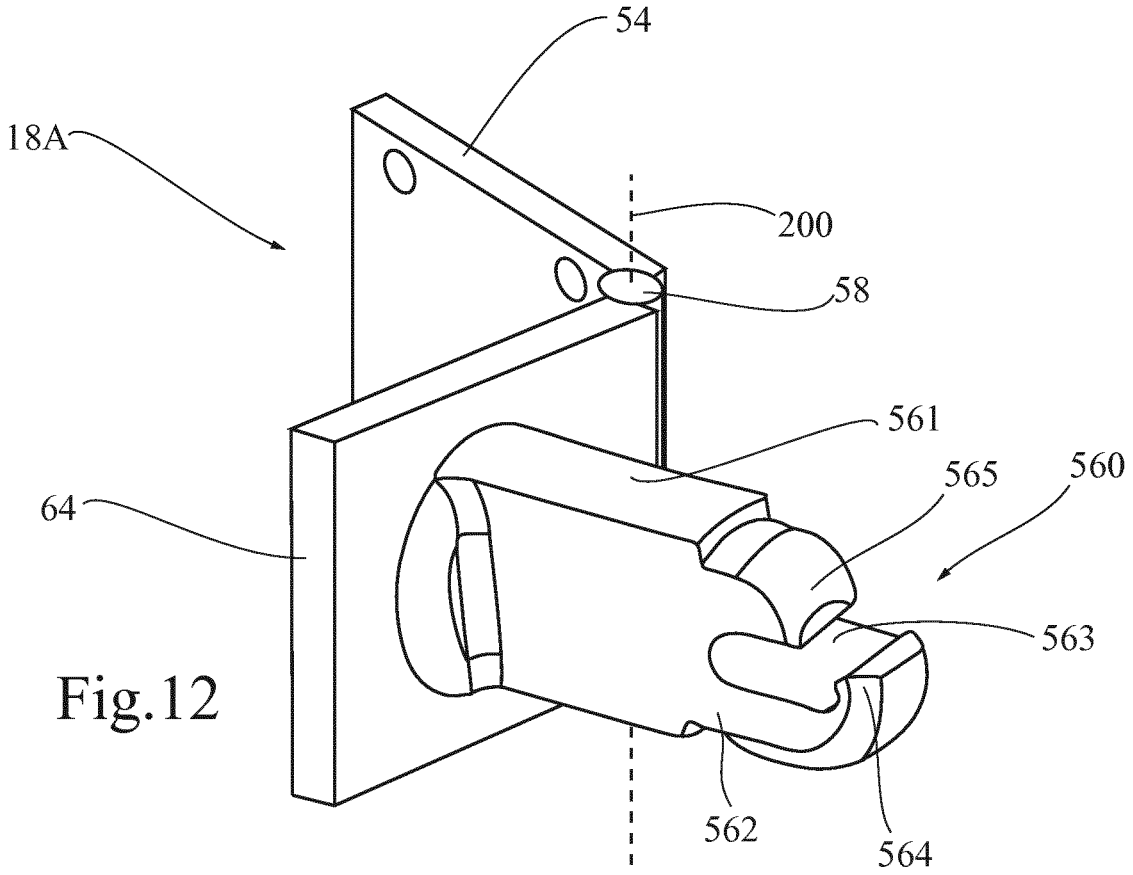
FIG. 12, a schematic view of another embodiment of the first wall attachment for the device for winding a screen.

According to a fifth embodiment illustrated in FIG. 8, the output shaft 32 of the actuator 22 is part of the first end portion 14A of the tubular winder 12, and is fixed in rotation around the reference axis 100 relative to the first wall attachment 16A. The winding tube 20 is secured to a driving wheel 34 to which the head 36 of the actuator 22 is fastened. A housing box 24 for the batteries or battery cells 26 is also fastened to the inside of the winding tube 20, for example fastened on the driving wheel 34 or on another wheel 134 of the same type. The rotating assembly formed by the winding tube 20, the case 30 of the actuator 22 and the housing box 24 for the batteries or battery cells 26 is guided in rotation relative to the reference axis 100 by a first bearing 42 mounted between the winding tube 20 and the output shaft 32 of the actuator 22, by a second bearing 44 mounted between the winding tube 20 and by a third bearing 144 placed between the housing box 24 and an end piece 47 fastened to the second wall attachment 18B. In this embodiment, it is possible, if applicable, to position a compensating spring 28 either between the output shaft 32 and the case 30 of the actuator 22, similarly to the first embodiment, or between the end piece 47 and the housing box 24 for the batteries or battery ceils 26 or the wheel 134 as shown in FIG. 8. In order to leave a passage to replace the batteries or battery cells 26, the end piece 47 has a passage, in particular able to be closed by a hatch 38, through which the batteries or battery cells 26 can pass. The hatch 38 is in particular connected to the second portion 14B by a bayonet device. Reliefs are provided on the outside of the hatch to make it possible to rotate the latter relative to the second portion 14B by hand or using a tool.

The compensating spring 28 may have to be locked or simply relaxed during changing of the batteries or battery cells 26. Alternatively, the compensating spring 28 may be installed around the actuator, similarly to the embodiment of FIG. 7.

FIGS. 9 to 11 show a winding device according to a sixth embodiment of the invention, which, like the previous embodiments, includes a tubular winder 12, a first articulated wall attachment 18A and a second wall attachment 18B. The figures also show a screen 70 wound on the winding tube 20 of the tubular winder 12. In a known manner, the screen 70 is provided at its free end with a load bar 72, which moves with the screen 70 during the unwinding and winding thereof, and is able to assume an extreme winding position, illustrated in FIGS. 9 to 11, in particular for assembly, disassembly or maintenance operations of the equipment. In the case at hand, the load bar 72 in the extreme winding position is jammed abutting against a first stop 74A secured to the first wall attachment 18A and against a second stop 74B secured to the second wall attachment 18B. It is alternatively or cumulatively possible to provide other fastening or maintaining means for the load bar 72 in the extreme winding position, for example strips with loops and hooks or elastic bands.

Figure 13:
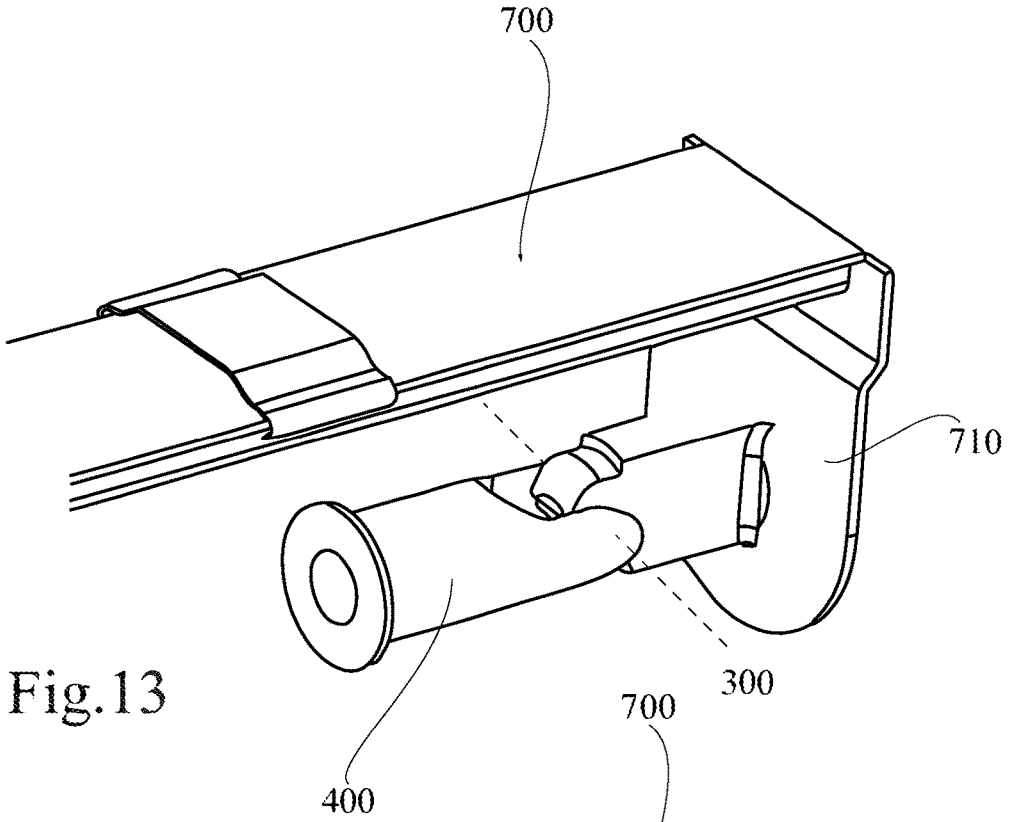
FIG. 13, a partial schematic view of a device for winding a screen according to another embodiment of the invention.
Figure 14:
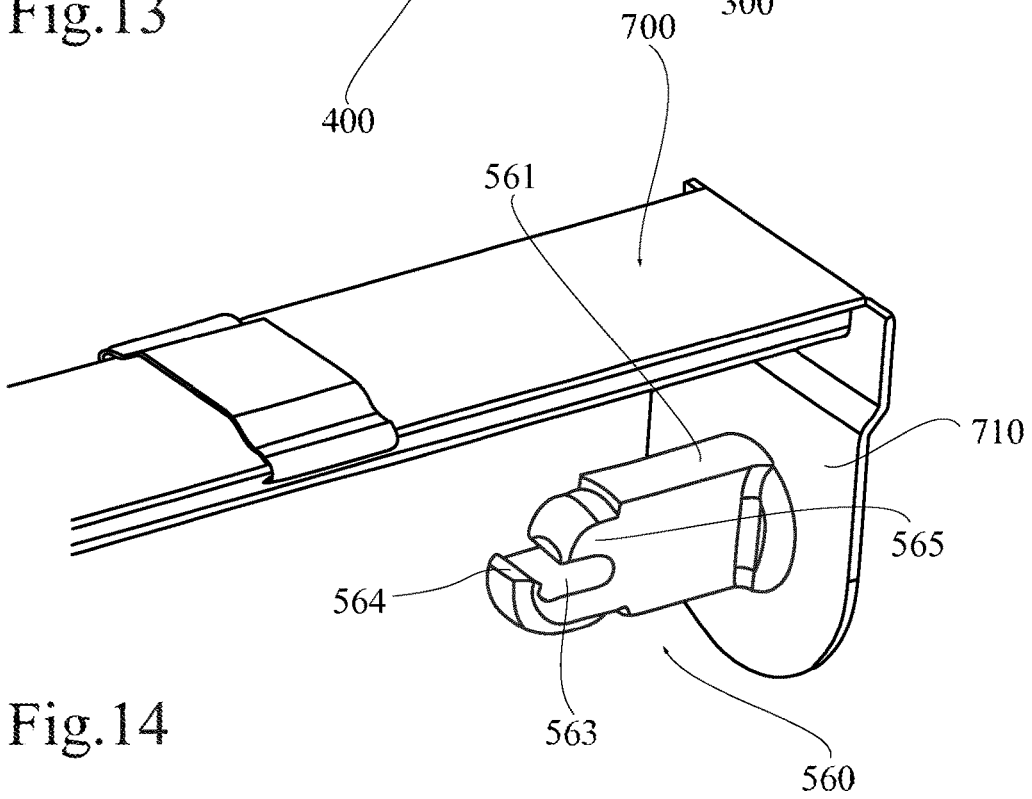
FIG. 14, a partial schematic view of a device for winding a screen according to the embodiment of FIG. 13.
Figure 15:
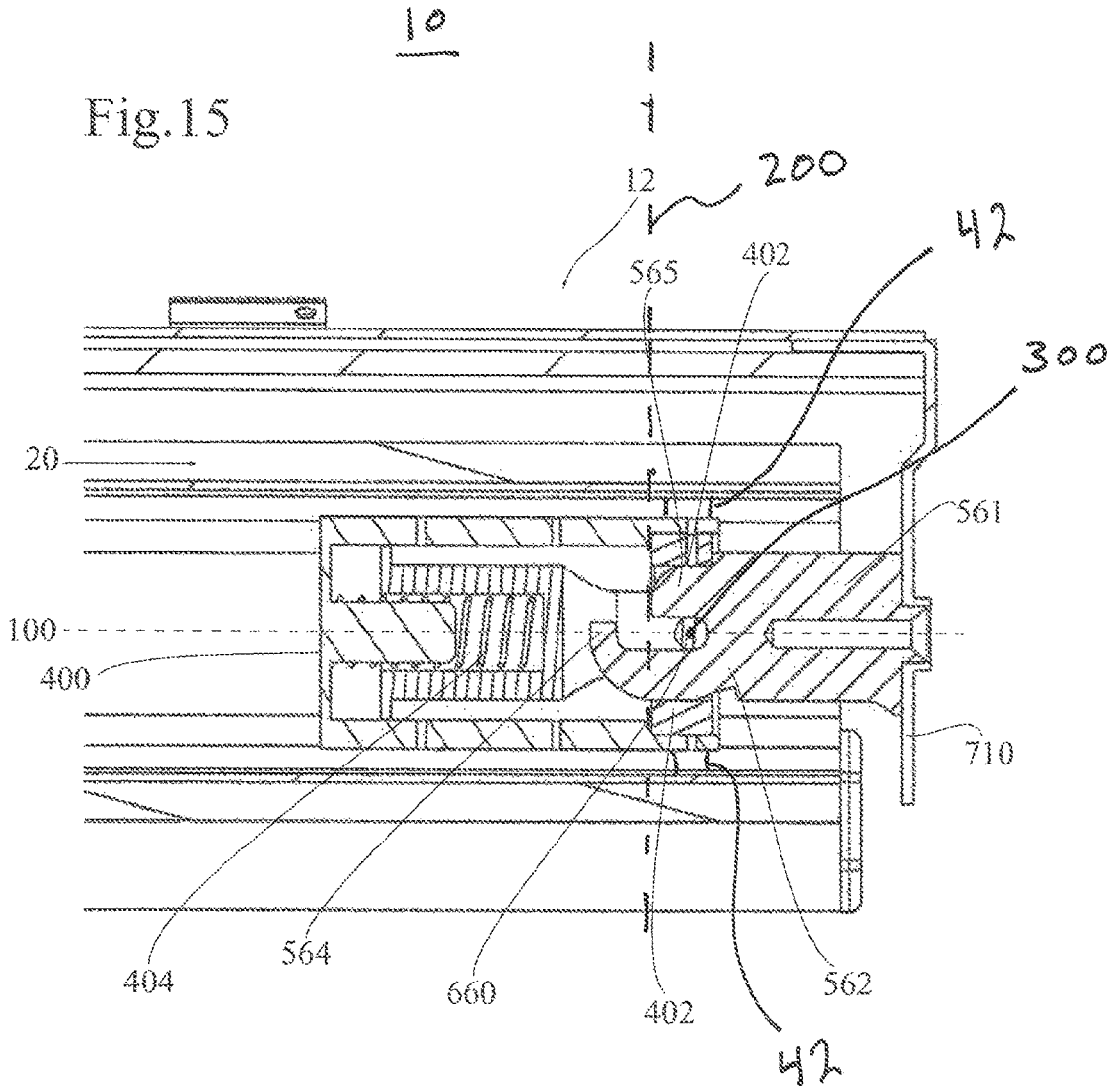
FIG. 15, a partial sectional schematic view of a device for winding a screen according to the embodiment of FIG. 13.

In one of alternative embodiment illustrated in FIGS. 13 to 15, the screen winding device 10 comprises a tubular winder 12 that includes a rigid frame 700 that extends from one end of the winding device to the other parallel to the reference axis 100, and which ends at one end with an intermediate tab 710, orthogonal to the reference axis 100. This intermediate tab 710 forms the first wall 18A. It can support a fastening tab 64, articulated along a rotation axis corresponding to the axis 200 and described above and/or an orientation tab 56, as discussed above, or a support 550, as shown in FIGS. 13, 14 and 15, rigidly fastened to the intermediate tab 710.

According to the embodiment illustrated in FIGS. 13, 14 and 15, the intermediate tab 710 can be provided with a support 560 secured and fixed relative to the intermediate tab 710. The support 560 may for example comprise, at its free end, a maintaining element 562 in the form of a hook, open on its upper part such that it can accommodate a transverse shaft 660 secured to the tubular winder 12. The support 560 includes a base 561 secured to the intermediate tab 64, and preferably fastened in the central part of its outer surface. The support 560 includes the maintaining element 562 in the extension of its base 561. This maintaining element 562 comprises a maintaining surface 563 and a stop 564 situated at its free end. The stop 564 can form a right angle relative to the maintaining surface 563 or assume a concave shape in the extension of the maintaining surface 563, so as to be able to hold a third-party element on the maintaining surface 563. The maintaining element 562 may further contain a lug 565 situated above the maintaining surface 563 and in the extension of the base 560. The lug 565 is shorter than the maintaining surface 563, such that the support 560 has an opening between the lug 565 and the stop 564. The maintaining element 562 is thus in the form of a hook. A third-party element can be inserted in the opening and slid over the maintaining surface 563 until it comes into contact with the base 561. In this case, the lug 565 makes it possible to keep the third-party element in contact with the maintaining surface 563 once placed against the base 561 and thus to keep the tubular winder suspended by the third-party element. The third-party element is for example the shaft 660, which can be secured to the winder 12, or an intermediate part 400 associated with the tubular winder 12. The intermediate part 400 may for example be inserted forcibly into the winding tube 20 or fastened to the winding tube by appropriate attached means such as screws or rivets.

In this embodiment, the intermediate part 400, rotatably connected to the winding tube 12 by first guide bearing 42 and provided at its end oriented toward the intermediate tab 710 with a shaft 660, is articulated on the support 560 by the cooperation of the shaft 660 and the maintaining element 562. The maintaining surface 563 has a length greater than the diameter of the shaft 660, which allows the latter to move along the maintaining surface, but also to be positioned slanted relative to the longitudinal axis of the support 560. This therefore makes if possible to articulate the intermediate part 400 relative to the support 560 along a first degree of freedom, called horizontal degree of freedom. The articulation along the horizontal degree of freedom defined above corresponds to the first hinge 58, able to guide pivoting of the winding tube 12 around a first axis of articulation 200, the first axis of articulation 200 in this embodiment being an axis perpendicular to the maintaining surface 563 and passing substantially through the center of this maintaining surface 563.

Likewise, the shaft 660 can pivot along its own longitudinal axis relative to the maintaining element 562, in particular when the shaft 660 is situated near the opening between the lug 565 and the stop 564 of the maintaining element 562. This therefore makes it possible to articulate the intermediate part 400 relative to the support 560 along a second degree of freedom, called vertical degree of freedom. The articulation along the vertical degree of freedom defined above corresponds to the second hinge 66, able to guide pivoting of the tubular winder 12 around a second axis of articulation 300, the second axis of articulation in this embodiment being an axis parallel to the longitudinal axis of the shaft 660.

The assembly of the tubular winder is simplified, and comprises the following steps:

- Positioning a first end portion 14A of the tubular winder 12 at the support 560 fastened to the first wall attachment 18A or intermediate tab 700,
- Positioning the shaft 660 at the opening of the maintaining element 562,
- Suspending the tubular winder from the support 560,
- Mobilizing the second portion 14B of the tubular winder 12 toward the second wall attachment 18B, stressing the articulation, in particular between the shaft 600 and the maintaining element 562, along the first axis of articulation 200 and/or the second axis of articulation 300,
- Attaching the retractable support link 68,
- Fastening the tubular winder at the second wall attachment 18B.

Preferably, when the shaft 660 is pushed back opposite the opening toward the other end of the maintaining surface 563, toward the intermediate tab 710, contact surfaces 402 of the intermediate part 400 cooperate with the maintaining element 562 to block the first degree of freedom and/or the second degree of freedom, i.e., to block the first hinge 53 and/or the second hinge 66 when the tubular winder 12 is in the extension of the support 560. The intermediate part 400 to that end in particular comprises a spring 440 intended to push back the shaft 660 toward the intermediate tab 710 when the tubular winder 12 is in the assembled position in the rigid frame 700. The assembly thus comprises an intermediate step in which the tubular winder is moved against the effect of the spring 404 toward the intermediate tab 710.

According to one particular aspect of the present invention, the screen winding device (10) includes one or more of the following elements:

- a tubular winder (12) defining a reference axis (100);
- a first wall attachment (18A) for fastening a first axial end portion (14A) of the tubular winder (12) to a first wall (16A), in a use position of the screen winding device (10); and
- a second wall attachment (18B) for fastening a second axial end portion (14B) of the tubular winder (12) to a second wall (16B), in the use position of the screen winding device (10);
- where the first wall attachment (18A) includes at least a first hinge (58) between at least one fastening tab (54) for fastening to the first wall (16A) and at least one intermediate tab 64 on which the tubular winder (12) is mounted, the first hinge (58) being able to guide the pivoting of the tubular winder (12) around a first axis of articulation (200) not secant with the reference axis (100) and, in the use position, orthogonal to the reference axis (100).

According to this particular aspect, the tubular winder (12) of the winding device may include a housing (24) for batteries or battery cells (26), the housing (24) preferably being situated inside a winding tube (20) of the tubular winder (12), the winding tube being guided in rotation around the reference axis (100) relative to the first wall attachment (18A) preferably on the side of the second portion (14B).

The tubular winder (12) according to this same aspect of the invention may further include a motorized actuator (22) for rotating the winding tube (20) around the reference axis (100), the actuator (22) preferably being at least partially housed inside the winding tube (20), and where the housing (24) for the batteries or battery cells (26) is situated inside a case (30) of the actuator (22) or between the case (30) of the actuator and the second end (14B).

The actuator (22) according to this same aspect of the invention includes a head (36) comprising a passage hatch for batteries or battery cells (26).

The second axial end portion (14B) of the tubular winder (12) includes an end piece (47) having a passage, in particular able to be closed by a hatch (38), and through which the batteries or battery cells (26) can pass.

The screen winding device according to this same aspect may further comprise the following elements:

a screen (70) wound on the winding tube (20), the screen (70) being provided with a load bar (72), and at least one stop (74A, 74B) secured to one of the first and second axial end portions (14A, 14B) of the tubular winder (14) or the first wall attachment (18A), and interfering with the load bar in an extreme winding position of the load bar (72).

The second wall attachment (18B) may be able to guide the second axial end portion (14B) of the tubular winder (12) when the tubular winder (12) pivots around the first axis of articulation (200), between an intermediate assembly position and the use position.

The winding device according to this aspect may include a retractable support link (68) between the second wall attachment (16B) and the second portion (14B) of the tubular winder (12), to support the second portion of the winder in a suspended position.

The first wall attachment (18A) of the screen winding device according to this aspect may include a second hinge (66) or swivel, supported by the fastening tab (54) to guide the rotation of the orientation tab (56) around at least one second axis of articulation (300) not secant with the reference axis, and not parallel to the first axis of articulation (200).

The first axis of articulation (200) and the second axis of articulation (300), in the use position of the winding device (10), can be coplanar or situated in two planes perpendicular to the reference axis and separated from one another by a distance smaller than the thickness of the first wall attachment.

The second axis of articulation (300) can be orthogonal to the first axis of articulation (200).

The tubular winder (12) of the winding device according to this aspect may include a compensating spring (28).

The compensating spring (23) can be kinematically connected by one end to the first wall attachment (18A) or to the second wall attachment (18B) and by a second end to a winding tube (20) of the tubular winder (12), the winding tube (20) being guided in rotation around the reference axis (100) relative to the first wall attachment (18A). The compensating spring (28) may be kinematically connected by a first end to a case (30) of the actuator (22) and by a second end to an output shaft (32) of the actuator (22).

Naturally, the examples shown in the figures and discussed above are provided solely as an illustration and are not limiting. It is explicitly set out that one may combine the various illustrated or described embodiments with one another to propose other embodiments.

The invention claimed is:

1. A screen winding device for winding a screen including:

a tubular winder defining a reference axis;

a first wall attachment for fastening a first axial end portion of the tubular winder to a first wall, in a use position of the screen winding device; and a second wall attachment for fastening a second axial end portion of the tubular winder to a second wall, in the use position of the screen winding device;

characterized in that the first wall attachment comprises a maintaining surface with a length along the reference axis, wherein the tubular winder comprises a shaft extending along a first axis of articulation and having a diameter less than the length of the maintaining surface, wherein the shaft is slidable along the maintaining surface, wherein rotation of the shaft relative to the maintaining surface allows the tubular winder to pivot about the first axis of articulation and wherein sliding engagement between the maintaining surface and the shaft allows the tubular winder to pivot around a second axis of articulation.

2. The screen winding device according to claim 1, characterized in that tubular winder includes a housing for batteries or battery cells, the housing being situated inside a winding tube of the tubular winder, the rotation of the winding tube around the reference axis being guided relative to the first wall attachment on a side of the second axial end portion.

3. The screen winding device according to claim 2, characterized in that the tubular winder includes a motorized actuator for rotating the tubular winder around the reference axis, the actuator being at least partially housed inside the winding tube, and in that the housing for the batteries or battery cells is situated inside a case of the actuator, or between the case of the actuator and the second axial end portion.

4. The screen winding device according to claim 3, characterized in that the actuator includes a head comprising a passage hatch for batteries or battery cells.

5. The screen winding device according to claim 2, characterized in that the second axial end portion of the tubular winder has an end piece having a passage, in particular able to be closed by a hatch, and through which the batteries or battery cells can pass.

6. The screen winding device according to claim 1, characterized in that the second wall attachment is able to guide the second axial end portion of the tubular winder when the tubular winder pivots around the first axis of articulation, between an intermediate assembly position and the use position.

7. The screen winding device according to claim 1, characterized in that the winding device includes a retractable support link between the second wall attachment and the second end portion of the tubular winder, to support the second end portion of the winder in a suspended position.

8. The screen winding device according to claim 1, characterized in that the maintaining surface comprises a maintaining element, the maintaining element comprising a hook at a first end of the maintaining surface.

9. The screen winding device according to claim 8, wherein the shaft cooperating with the maintaining surface maintains the tubular winder suspended from the maintaining surface.

10. The screen winding device according to claim 9, further comprising a spring connected with the shaft, wherein the shaft is moveably connected with the tubular winder to move along the reference axis relative to the tubular winder and is biased toward the first axial end by the spring, wherein the maintaining surface further comprises a lug at a second end of the maintaining surface opposite the first end of the maintaining surface, and wherein contact between the shaft and the lug blocks pivoting of the tubular winder about the first or second axis of articulation.

11. The screen winding device according to claim 1, characterized in that the second axis of articulation is orthogonal to the first axis of articulation.

12. The screen winding device according to claim 1, characterized in that the first axis of articulation intersects with the reference axis and in that the second axis of articulation intersects with the reference axis.

13. The screen winding device according to claim 1, characterized in that the tubular winder includes a compensating spring.

* * * * *